US006102030A

United States Patent [19]

Brown et al.

[11] Patent Number: 6,102,030

[45] Date of Patent: Aug. 15, 2000

[54] FURNACE VENT AND INTAKE TERMINAL AND BLOCKAGE SAFETY SHUT DOWN SYSTEM

[75] Inventors: Michael N. Brown, Waterloo; Gary Wallet, Harley; Dan C. Dobre, Kitchener, all of Canada

[73] Assignee: International Comfort Products Corporation (Canada), Toronto, Canada

[21] Appl. No.: 09/438,501

[22] Filed: Nov. 12, 1999

Related U.S. Application Data

[63] Continuation of application No. 09/046,682, Mar. 24, 1998.

[51] Int. Cl.[7] ..... F24C 3/00

[52] U.S. Cl. ..... 126/85 B; 126/307 A; 126/312; 454/8

[58] Field of Search ..... 126/85 B, 307 R, 126/312, 307 A, 116 A; 431/20, 89; 454/8, 35, 36

[56] References Cited

U.S. PATENT DOCUMENTS

| | | | |
|---|---|---|---|
| 2,711,683 | 6/1955 | Ryder | 98/48 |
| 3,105,432 | 10/1963 | Chamberlain | 126/85 B |
| 3,428,040 | 2/1969 | Baker et al. | 126/110 R |
| 3,550,579 | 12/1970 | Baker | 126/307 |
| 3,552,377 | 1/1971 | Hodges | 126/85 B |
| 3,643,646 | 2/1972 | Honaker, Jr. | 126/85 B |
| 3,654,913 | 4/1972 | Derringer et al. | 126/121 |
| 3,994,280 | 11/1976 | Winters et al. | 126/307 A |
| 4,286,569 | 9/1981 | Bergman et al. | 126/85 B |
| 4,424,792 | 1/1984 | Shimek et al. | 126/80 |
| 4,651,710 | 3/1987 | Henault | 126/85 B |
| 4,690,129 | 9/1987 | Halstead | 126/85 B |
| 4,699,317 | 10/1987 | Childs | 237/81 |
| 4,793,322 | 12/1988 | Shimek et al. | 126/80 |
| 4,909,227 | 3/1990 | Rieger | 126/531 |
| 4,951,651 | 8/1990 | Schllenberger | 126/116 R |
| 4,995,375 | 2/1991 | Jackson | 126/85 B |
| 5,012,793 | 5/1991 | Guzorek | 126/85 B |
| 5,016,609 | 5/1991 | Shimek et al. | 126/85 B |
| 5,062,354 | 11/1991 | Goins | 98/62 |
| 5,261,389 | 11/1993 | Trieb | 126/85 B |
| 5,282,456 | 2/1994 | Smelcer et al. | 126/85 B |
| 5,320,086 | 6/1994 | Beal et al. | 126/512 |
| 5,452,708 | 9/1995 | Shimek et al. | 126/512 |
| 5,551,414 | 9/1996 | Quick | 126/85 B |
| 5,562,088 | 10/1996 | Valters et al. | 126/85 B |
| 5,647,342 | 7/1997 | Jamieson et al. | 126/512 |
| 5,715,808 | 2/1998 | Wilhoite | 126/85 B |

FOREIGN PATENT DOCUMENTS

| | | |
|---|---|---|
| 2381244 | 9/1978 | France . |
| 3438320 | 9/1978 | Germany . |
| 189410 | 7/1989 | Japan . |
| 771986 | 4/1957 | United Kingdom . |
| 1386447 | 5/1975 | United Kingdom . |

*Primary Examiner*—James C. Yeung
*Attorney, Agent, or Firm*—Bereskin & Parr

[57] ABSTRACT

A horizontal combined air intake and combustion gas vent terminal assembly is provided having improved wind pressure response and anti-recirculation characteristics. The terminal has a vent conduit disposed inside an air intake conduit. A scoop assembly is provided at the intake conduit inlet to increase the intake air pressure at the inlet. The vent conduit is nozzle-like to throttle combustion gases, thereby accelerating the gases and permitting the terminal to project the gases away from the intake conduit terminal. Vent conduit is disposed asymmetrically with intake conduit to further discourage mixing of intake air and combustion gases. The terminal may also be provided with a static pressure measuring means to provide an intrinsic safety shut down system within the terminal in case of blockage of the intake or vent by snow, ice or other debris.

3 Claims, 13 Drawing Sheets

FURNACE VENT AND INTAKE TERMINAL AND BLOCKAGE SAFETY SHUT DOWN SYSTEM

RELATED APPLICATION

This application is a continuation of application Ser. No. 09/046,682, filed on Mar. 24, 1998.

FIELD OF THE INVENTION

This invention relates to fuel-fired heating appliances, and more particularly to a combined vent and air intake terminal for such appliances.

BACKGROUND OF THE INVENTION

Combined air intake and combustion gas vent terminals, sometimes referred to as vent/intake terminals, have long been used with fuel-fired heating appliances, particularly side wall-vented gas fireplaces and furnaces. Combined vent/intake terminals typically comprise concentrically mounted vent and intake conduits, with a larger intake conduit disposed around a smaller vent conduit. The terminal is installed in an exterior wall of a building, with the intake and vent openings exterior to the building. The recent popularity of side wall-vented furnaces, also known as horizontally-vented or direct-vented furnaces, is due to the ease with which the required air intake and flue systems may be installed in a building. Correspondingly, there has been an increased demand for vent/intake terminals because such devices simplify installation effort and cost, as only a single fixture need be installed.

A problem commonly encountered with vent/intake terminals, however, is an unwanted recirculation of combustion gases into the terminal intake, which reduces the efficiency of combustion in the fuel-fired appliance. Such recirculation is principally caused by the close proximity of the intake and vent openings. Prior art vent/intake terminals typically have attempted to minimize recirculation by placing an anti-mixing baffle or separator between the intake and vent openings. The anti-mixing baffle is usually a baffle member disposed around the vent outlet to block direct axial access to the intake inlet, thereby impeding direct recirculation of axially vented combustion gases into the intake inlet of the terminal. Intake air enters the terminal radially, between the baffle and the building wall, then turning 90° to travel axially though the intake conduit of the terminal. Thus, although the terminal conduits are concentric, the baffle causes the radial flow of intake air to be physically separated from the axial flow of vented combustion gases, thereby impeding mixing.

These prior art terminals, however, have disadvantages. One well-known disadvantage results from wind-induced pressure effects on the operation of the terminal. The differing orientations of the intake and vent openings in the prior art terminals result in a wind-induced pressure differential between the openings. For example, a direct axial wind would blow directly on the axially-oriented vent outlet, but the radially-oriented intake opening would be shielded by the anti-mixing baffle, creating a dynamic pressure differential. A wind-induced pressure differential is undesirable because it modifies the pressure differential generated by the appliance between the intake and vent openings, hereinafter referred to as the combustion pressure differential. The combustion pressure differential, which causes intake air to be induced into the appliance and combustion gas expelled therefrom, is carefully balanced in high-efficiency furnaces to permit an efficient combustion of fuel in the appliance. Wind effects at the terminal, however, unbalance the combustion pressure differential between the intake and vent, adversely affecting the efficiency and/or operation of the appliance.

One solution to the wind pressure problem experienced with prior art terminals is suggested in U.S. Pat. No. 5,282,456 to Smelcer. This patent discloses a combined vent/intake terminal, for use with an induced draft, natural gas furnace, which has axially-aligned and unimpeded intake and vent openings. This avoids the wind-blocking effect of the anti-mixing baffle of the prior art. To impede mixing without using an anti-mixing baffle, the vent opening of the '456 terminal is extended axially away from the wall, and away from the intake opening, to increase the distance between the intake openings and the vent openings. To further impede mixing, the '456 terminal relies on the draft inducer fan of an induced draft furnace to forcibly eject combustion gases through the vent opening, thereby projecting combustion gases further away from the wall and from the intake opening.

The design of the '456 terminal, however, also has disadvantages. Foremost among these is the terminal's reliance on a reasonably high pressure draft inducer fan to forcibly eject combustion gases from the terminal, thereby limiting mixing of intake and combustion gases. Furthermore, the speed and pressure at which the draft inducer fan operates reduces the sensitivity of the vent/intake system to wind-induced pressure imbalances across the intake inlet and vent outlet.

Today, oil-fired furnaces are becoming more popular. These furnaces are sometimes referred to as a positive pressure furnace because the combustion draft inducing means responsible for generating the combustion pressure differential is located on the intake side of the furnace rather than the vent side, contrary to induced draft gas furnaces. The combustion pressure differential generated in a positive pressure furnace, however, is significantly smaller than that generated by the draft inducer fan of an induced draft gas furnace, and in some cases may be only one tenth as much. A reduced combustion pressure differential causes positive pressure furnaces to be more sensitive to wind effects than induced draft gas furnaces. Furthermore, the reduced combustion pressure differential results in lower vent gas speeds at the vent outlet, making a concentric vent/intake terminal used therewith more susceptible to permitting recirculation of vent gases.

The combined intake/vent terminal of the '456 patent, when used with a positive pressure furnace, has limited wind pressure balancing characteristics. While the pressure imbalances permitted by the '456 terminal are overcome by the draft inducer fan of an induced draft furnace, the '456 terminal is significantly less effective when used with a positive pressure furnace. Furthermore, the '456 terminal permits an unacceptable amount of mixing of intake air and combustion gas due to the lower speed at which vent gases are expelled from a positive pressure furnace, especially when a direct frontal wind is encountered. Accordingly, there is a need for a intake/vent terminal with improved pressure-balancing and anti-recirculation characteristics.

Combined vent/intake terminals are also susceptible to partial or complete blockage of the intake and/or vent openings, by snow, ice or other environmental debris. If furnace combustion is permitted to continue when the intake and/or vent openings are blocked, excessive smoking can result, endangering the safe and efficient operation of the appliance. Accordingly, the vent and intake pressures should be monitored by the furnace control system and, if a blockage is sensed, the operation of the burner ceased.

Prior art safety shut down systems of this nature, however, have relied on pressure sensors and pressure switches located in, or immediately adjacent, the fuel fired appliance itself. These have the disadvantage that the pressure sensing systems must be calibrated to compensate for various firing rates, and for pressure effects of aerodynamic friction occurring in the furnace intake/vent piping system used, such effects depending on the size, length and configuration of the intake and venting conduits. Accordingly, there is a need for an improved safety shutdown system for detecting furnace vent and intake blockage.

SUMMARY OF THE INVENTION

In one aspect, the present invention is directed to a horizontal air intake and combustion gas vent terminal positionable in an exterior wall of a building for admitting outside air to a fuel fired furnace in the building and venting combustion gas therefrom to the outside of the building, the terminal comprising:

(a) a vent conduit for receiving combustion gases from the furnace, the vent conduit having an open vent outlet end positionable to extend outwardly from the exterior wall for venting the combustion gases to the outside of the building;

(b) an intake conduit disposed around the vent conduit having an air flow space defined therein in cooperation with the vent conduit for receiving a horizontal flow of outside air through an open intake inlet end and delivering said air through the air flow space to the furnace, the intake inlet end being positionable between the vent outlet end and the wall;

(c) a sleeve member disposed around the intake conduit having a first end merged with the intake conduit and a second end positionable to extend outwardly from the wall to a position intermediate the intake inlet end and the vent outlet end, the sleeve member having a first surface; and (d) a shield member disposed around the vent conduit and spaced apart from the intake inlet end, the shield member extending from the vent conduit towards the sleeve member to a position wherein the shield member substantially blocks direct axial access of air to the intake inlet end, the shield having a second surface, whereby the first and second surfaces cooperate to form an air intake passage therebetween, the air intake passage being in flow communication with the intake inlet end.

In a second aspect, the present invention is directed to a horizontal air intake and combustion gas vent terminal positionable in an exterior wall of a building for admitting outside air to a fuel fired furnace in the building and venting combustion gas therefrom to the outside of the building, the terminal comprising:

(a) a vent conduit for receiving combustion gases from the furnace, the vent conduit having a length and an open vent outlet end positionable to extend outwardly from the exterior wall for venting the combustion gases to the outside of the building, the vent conduit being tapered along the length thereof towards the vent outlet end for accelerating a flow of combustion gas therethrough; and (b) an intake conduit disposed around the vent conduit having an air flow space defined therein in cooperation with the vent conduit for receiving a horizontal flow of outside air through an open intake inlet end and delivering said air through the air flow space to the furnace, the intake inlet end being positionable between the vent outlet end and the wall.

In a third aspect, the present invention is directed to a horizontal air intake and combustion gas vent terminal positionable in an exterior wall of a building for admitting outside air to a fuel fired furnace in the building having a burner and venting combustion gas therefrom to the outside of the building, the terminal comprising:

(a) a vent conduit for receiving combustion gases from the furnace, the vent conduit having an open vent outlet end positionable to extend outwardly from the exterior wall for venting the combustion gases to the outside of the building;

(b) an intake conduit disposed around the vent conduit having an air flow space defined therein in cooperation with the vent conduit for receiving a horizontal flow of outside air through an open intake inlet end and delivering said air through the air flow space to the furnace;

(c) pressure switch assembly for comparing the static pressure in the vent conduit to the static pressure in the intake conduit and selectively interrupting the operation of the burner in the furnace in response to a preset pressure difference between the vent and intake conduits.

In a fourth aspect, the present invention is directed to a method for shutting down the operation of a furnace located in a building in response to a environmental blockage of an intake or vent connected to the furnace, the furnace having a burner and an electric circuit to control the operation of the burner, the blockage occurring outside the building, the method comprising:

(a) providing a vent terminal in flow communication with the vent and positioned exterior to the building;

(b) providing an intake terminal in flow communication with the intake and positioned exterior to the building;

(c) providing a switch connected to the electric circuit;

(d) comparing the air pressures inside the vent terminal and the intake terminal; and (e) opening the switch in response to a preset difference between the vent terminal pressure and intake terminal pressure to interrupt the operation of the burner in the furnace.

BRIEF DESCRIPTION OF THE DRAWINGS

For a better understanding of the present invention, and to show more clearly how it may be carried into effect, reference will now be made by way of example only to the accompanying drawings. These drawings illustrate the preferred embodiments of the present invention, in which.

DETAILED DESCRIPTION OF THE PREFERRED EMBODIMENT

Figure 1:
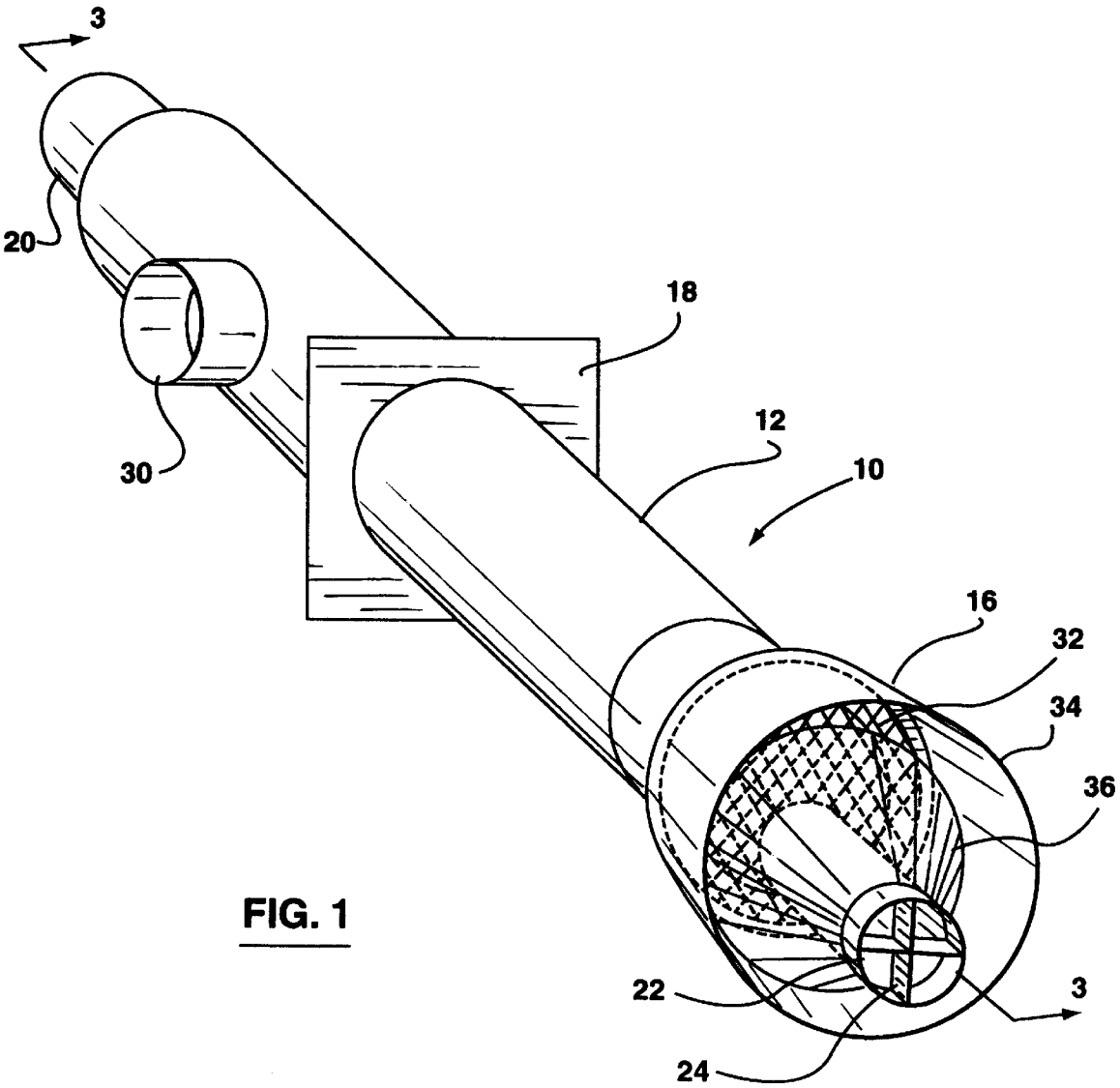
FIG. 1 is an isometric view of the vent terminal assembly according to a preferred embodiment of the present invention.
Figure 2:
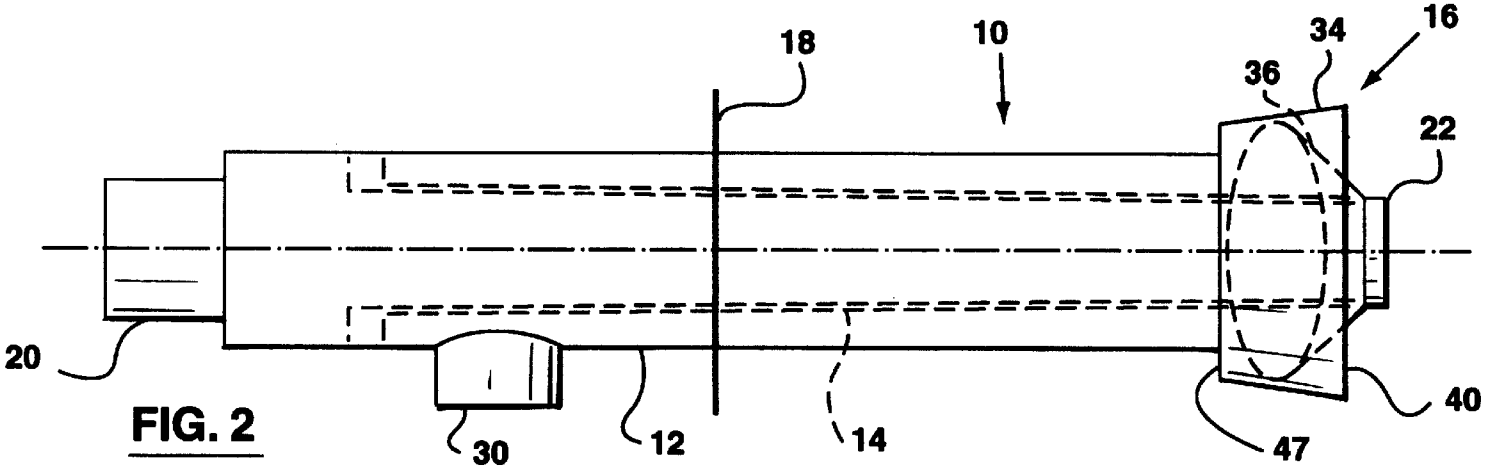
FIG. 2 is a sectional top view of the device of FIG. 1, taken through the line 2—2.
Figure 3:
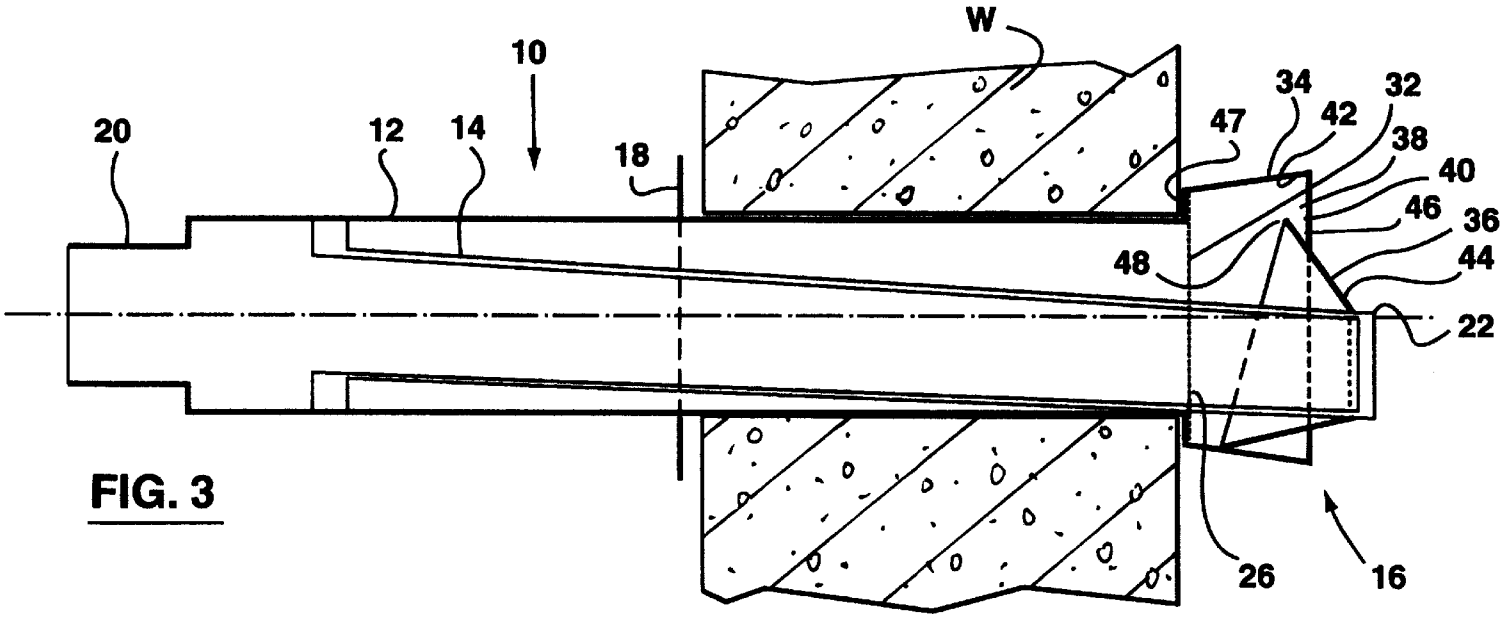
FIG. 3 is a sectional side view of the device of FIG. 1, taken through the line 3—3.

Referring to FIGS. 1, 2 and 3, a combined air intake and combustion gas vent terminal in accordance with the present invention is shown generally at 10. Terminal 10 has an intake conduit 12 and a vent conduit 14, a scoop assembly 16, and a inside mounting plate 18. Terminal 10 is mounted in a wall W of a building, and positioned such that scoop assembly 16 is outside the building, and inside mounting plate 18 is appropriately secured to fix terminal 10 in place. Vent conduit 14 has a vent pipe connection 20 for receiving combustion gases from a furnace vent duct (not shown) and an outlet end 22 for venting the gases to the outside of the building. Outlet end 22 has a grate 24 to prevent the entry of environmental debris into outlet end 22. Intake conduit 12 has an inlet end 26 for receiving intake air from the outside of the building, and an intake pipe connection end 30 for delivering intake air to a furnace intake duct (not shown). A screen 32 is provided to prevent the entry of environmental debris into inlet end 26.

Scoop assembly 16 comprises an outer sleeve member 34 and an inner shield member 36, which cooperate to form an air inlet passage 38 in flow communication with inlet end 26. Air inlet passage 38 has an air entry region 40 defined between surface 42 of sleeve 34 and surface 44 of shield 36. Sleeve 34 merges at one end with intake conduit 12 adjacent inlet end 26, and extends outwardly away from wall W to an open end 46, positioned intermediate wall W and vent outlet 22. Sleeve 34 also has an integral outside wall mounting plate 47 which abuts wall W. Shield 36 surrounds vent conduit 14 and extends outwardly therefrom to a shield edge 48. Shield edge 48 is axially positioned intermediate inlet end 26 and open end 46. Shield edge 48 extends outwardly from vent conduit 14 sufficiently to substantially block direct axial access to intake conduit 12. Thus, air entering intake air passage 38 through air entry region 40 is diverted around shield member 36 as it travels towards inlet 26. The function and structure of scoop assembly 16 will be discussed in more detail below.

Vent conduit 14 is tapered as it extends from vent pipe connection 20 to outlet end 22. In the preferred embodiment, vent conduit 14 has approximately a 3° to 5° taper along its length of approximately 24 inches. Vent conduit 14 is tapered to throttle or accelerate combustion gases passing therethrough to increase the exit velocity of the gases at outlet end 22. The throttling of combustion gases provides momentum to the combustion gas flow, advantageously reducing recirculation by causing combustion gases to be projected away from intake air inlet passage 38 and away from wall W. Projection of combustion gases away from wall W also reduces soot and/or ice build up on wall W, which can be caused by the combustion byproducts and water content of the gases expelled by terminal 10.

To further improve the anti-recirculation characteristics of terminal 10, vent conduit 14 is preferably asymmetrically mounted within intake conduit 12, such that outlet 22 is adjacent one edge of inlet 26, and pointing in a generally downwardly direction. An asymmetric alignment provides two advantages. Firstly, and most importantly, the downward positioning of outlet 22 provides maximum physical separation between ejected outlet gases and intake air entering air entry region 40, which separation improves the anti-recirculation characteristics of terminal 10. The downward slope also permits any condensation forming in vent conduit to flow outwardly and drip from outlet end 22 to the ground below.

The physical separation of outlet 22 and air entry region 40 is also increased by the presence of shield member 36. In addition to a pressure compensation and stabilizing function described below, shield member 36 acts as a physical shield to prevent direct axial recirculation of combustion gases into intake conduit 12.

Surface 42 of sleeve 34 and surface 44 of shield 36 preferably cooperate to give air entry region 40 an axially inwardly tapering scoop-like shape. Sleeve surface 42 preferably has a radial outward taper as it extends towards open end 46. The amount of taper is preferably between 0° and 45°. For reasons described in more detail below, the preferred embodiment has a about a 10° outward taper. Shield surface 44 preferably has a taper, opposite in direction to the taper of shield surface 42, as shield 36 extends radially towards shield edge 48. As a result of such preferred taper, shield 36 is frustoconical in shape. The amount of taper of shield 36 is affected by the asymmetrically placement of vent conduit 14 within intake conduit 12. Accordingly, one skilled in the art will understand that the angle of taper of shield 36 changes as a function of circumferential position on vent conduit 14. If vent conduit 14 is concentrically located within intake conduit 12, shield may be symmetrically frustoconical in shape and have a constant taper angle.

As one skilled in the art will appreciate, the preferred overall scoop or nozzle shape defined by surfaces 42 and 44 in the air entry region 40 of scoop assembly 16 acts to increase the inlet air pressure in air entry region 40. An increase in pressure is required to balance the effect of wind on the combustion pressure differential maintained between inlet 26 and outlet 22, as will be discussed further below.

In normal operation, in a zero wind condition, air is drawn into inlet 26 by the creation of a slight negative pressure at air entry region by a combustion blower located in a burner assembly on a furnace to which terminal 10 is connected (not shown). Correspondingly, combustion gases are provided to terminal 10 and vented through outlet 22, creating a slight positive pressure just upstream of outlet 22. The difference between these inlet and outlet pressures is the normal operating combustion pressure differential of the furnace. Such pressure differential is carefully chosen to achieve efficient operation of the furnace.

Figure 4:
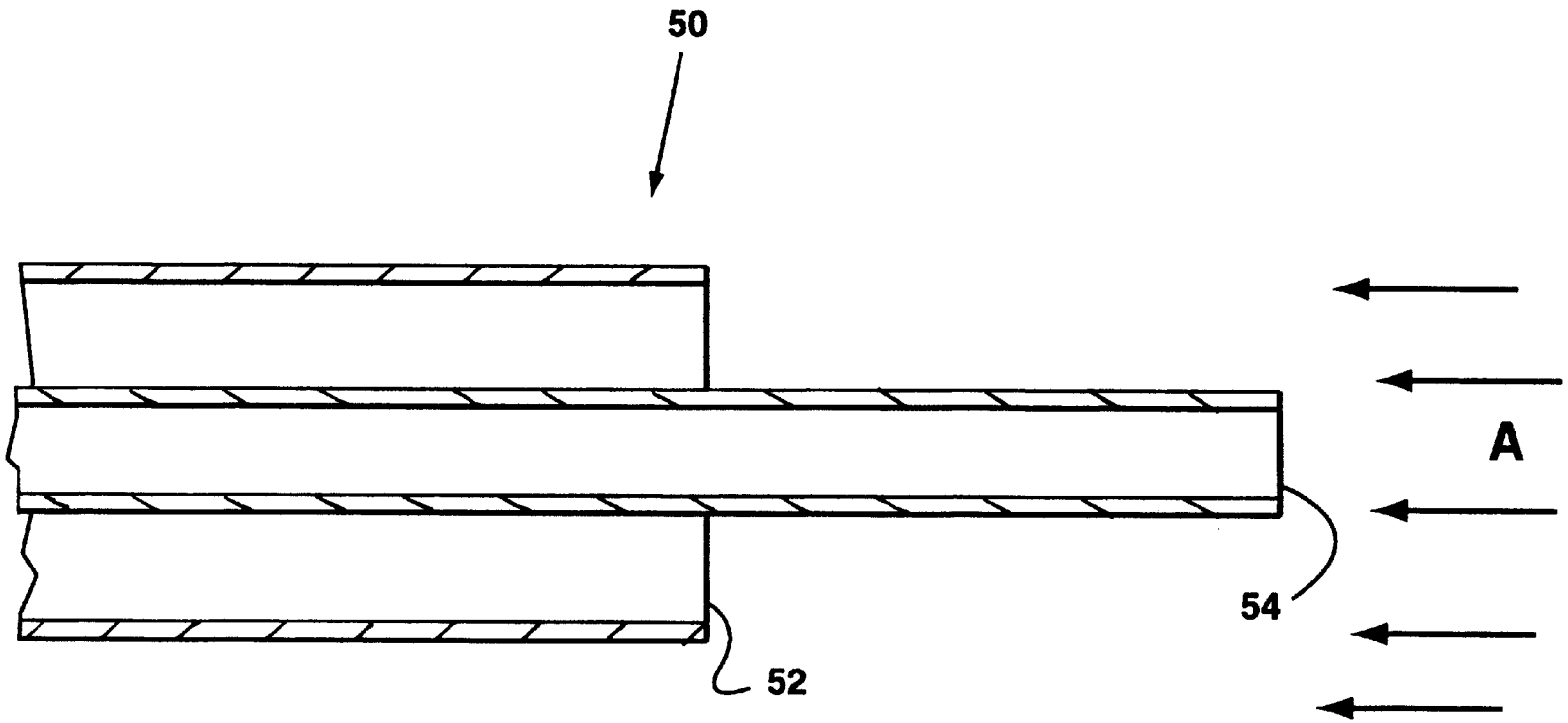
FIG. 4 ( Prior art )
FIG. 4 is a sectional side view of a concentric vent/intake terminal according to the prior art.

Referring to FIG. 4, the arrow A indicates a wind A blowing directly on a concentric vent/intake terminal 50 according to the prior art, the terminal having an inlet 52 and an outlet 54. When a positive pressure furnace is connected to terminal 50, and is put into operation so as to pull intake air into inlet 52 and exhaust combustion gases out through outlet 54, wind A detrimentally causes a pressure imbalance in the combustion pressure differential. Although wind A increases the pressure at both inlet 52 and outlet 54, it has been found that the pressure increase at inlet 52 is less than the pressure increase at outlet 54. The increased pressure differential detrimentally affects the efficiency and/or the operation of the furnace. Higher winds speeds only serve to amplify this unwanted effect.

Referring again to FIG. 3, terminal 10 of the present invention addresses the wind pressure imbalance problems caused in the prior art by providing scoop assembly 16. Shield 36 prevents direct axial access to intake conduit 12 by a direct wind. Furthermore, the cooperating surfaces 42 and 44 act as a nozzle, which one skilled in the art will understand causes a pressure increase at air entry region 40. The angle of taper of surfaces 42 and 44 are chosen to cause a pressure increase corresponding to the expected pressure decrease caused by a wind blast. Current governmental certification requirements require a vent/intake terminal to function effectively and properly in a 40 mph wind. Thus, the taper angles should be chosen to provide good pressure balancing characteristics at least to this wind speed, though it would be desirable to exceed these levels to provide yet better performance.

Figure 5:
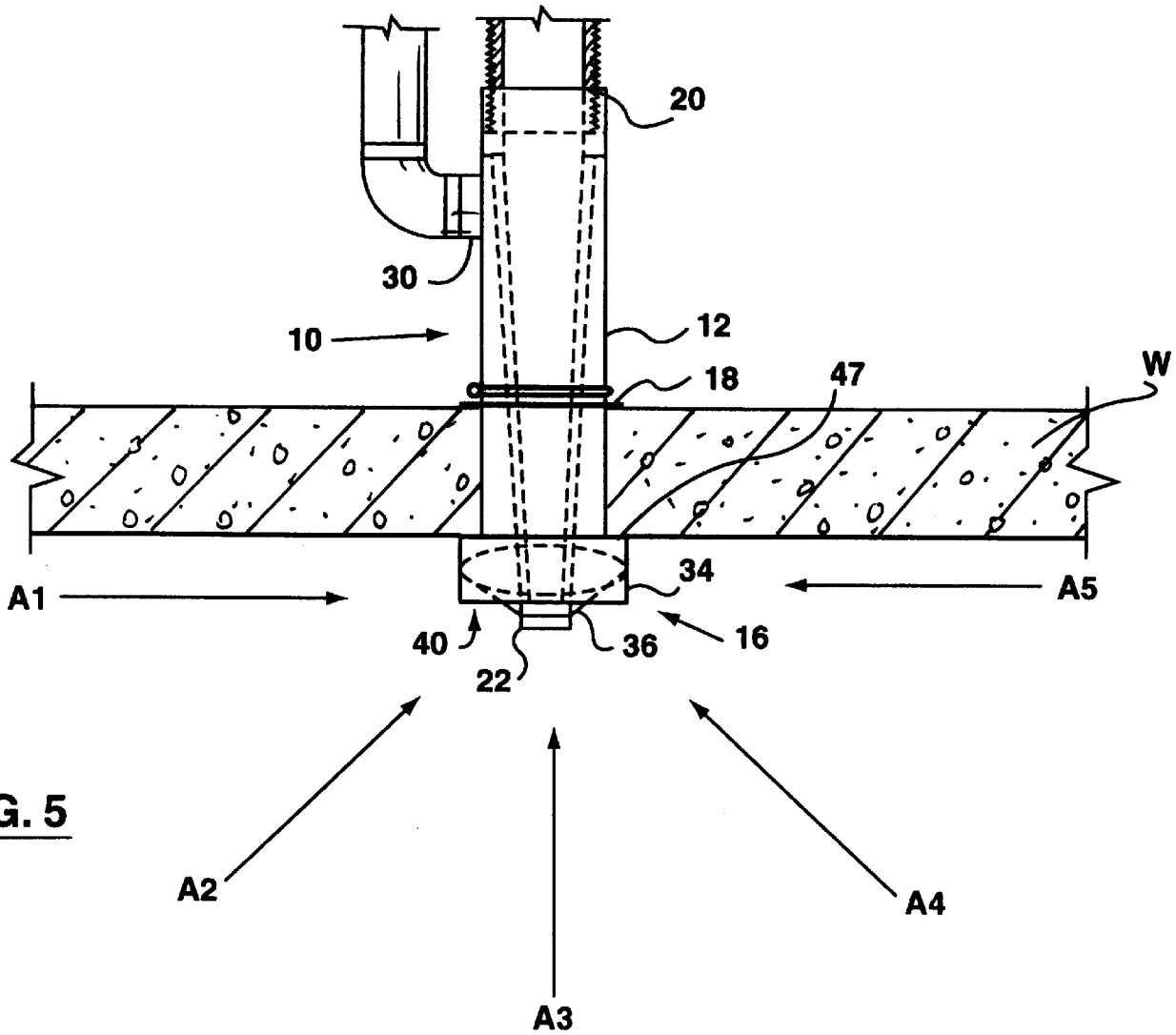
FIG. 5 is a top view of the device of FIG. 1, shown installed in the wall of a building.

Referring to FIG. 5, a taper for surfaces 42 and 44 of terminal 10 can also be chosen to optimize pressure balance characteristics for various wind directions, represented in FIG. 5 by arrows $A_1$ to $A_5$. As one skilled in the art will appreciate, the pressure effects of winds from directions $A_1$ and $A_3$ have greatly different pressure effects on terminal 10, $A_1$ cause a strongly pressure decrease and $A_3$ causing a strong pressure increase. As described above, shield 36 need not be symmetrically frustoconical, but may have a varying taper around vent conduit 14. Accordingly, the taper may vary with circumferential position to optimize the response of terminal 10 to winds for various angles.

Several factors affect the response characteristics of the terminal 10, and one skilled in the art will understand that certain adjustments to one aspect of the design will have a corresponding effect on other aspects. The axial set back of shield 36 within sleeve 34, the diameter of sleeve 34, the taper angle of surfaces 42 and 44 are factors which, jointly and severally, affect the wind pressure balancing characteristics of the terminal 10. Changes to these parameters may be made to optimize the terminal 10 for a given operational environment.

These certain modifications to optimize performance of terminal 10 may be made without departing from the scope of the present invention. For example, the shield 36 may be disc-like and disposed vertically within sleeve 34. With such an embodiment, the desired nozzle effect of scoop assembly 16 is be provided completely by surface 42 of sleeve 34. In another embodiment, sleeve 34 may be cylindrical (ie. having 0° taper) and shield member 36 frustoconical. With this particular embodiment, the desired nozzle effect of scoop assembly 16 must be provided mostly by surface 44 of shield 36. Yet other embodiments will be obvious to one skilled in the art. One skilled in the art will also recognize that benefits from the present invention are still achieved if shield 36 is disc-like and sleeve 34 is cylindrical. In each case, the taper angle, if any, and size of the relevant components will affect the pressure balancing characteristics of the terminal 10. Some testing may be required to optimize the choice of parameters for a given operational condition.

Figure 6:
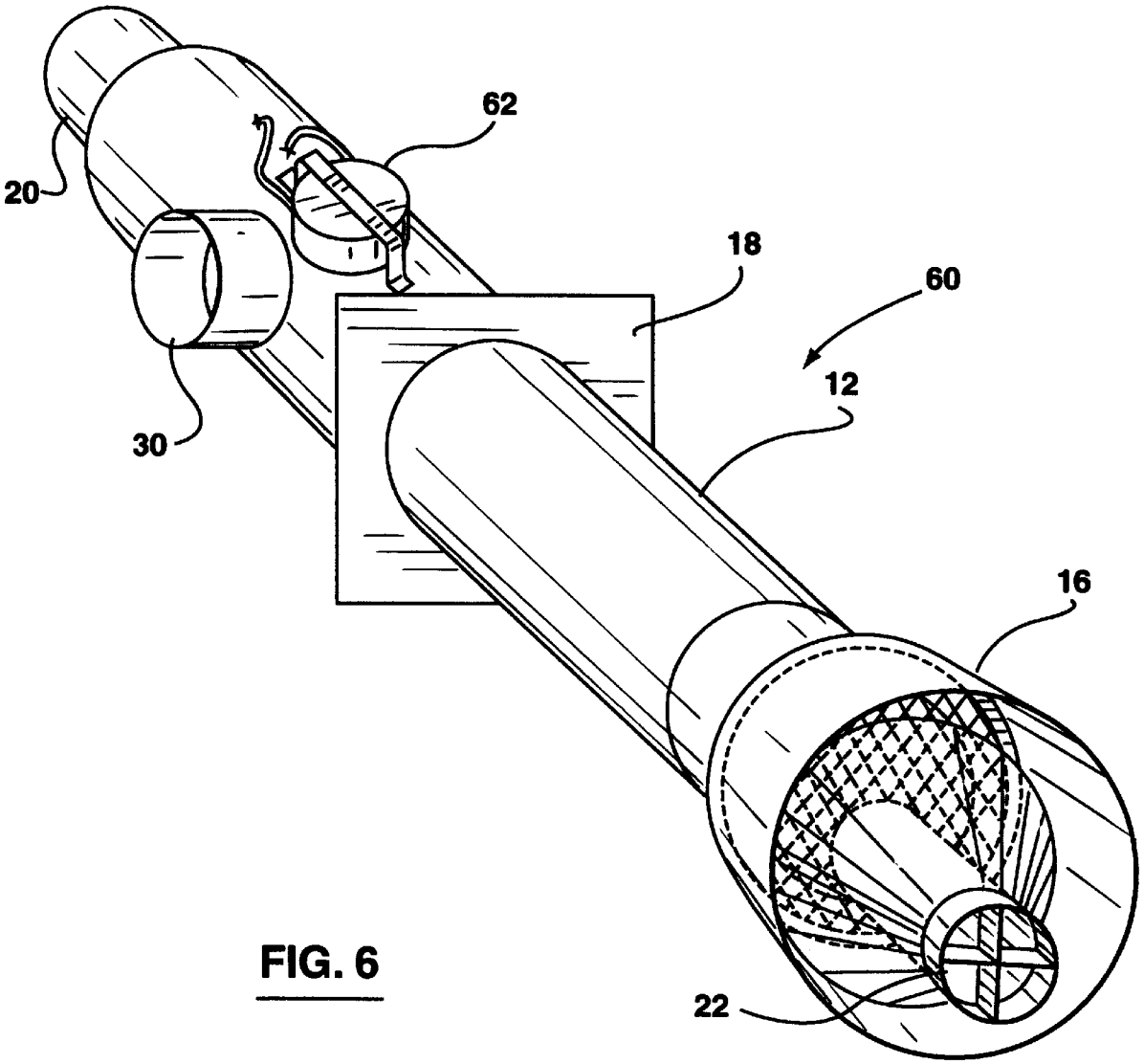
FIG. 6 is an isometric view of the vent terminal assembly according to an alternate embodiment of the present invention.
Figure 7:
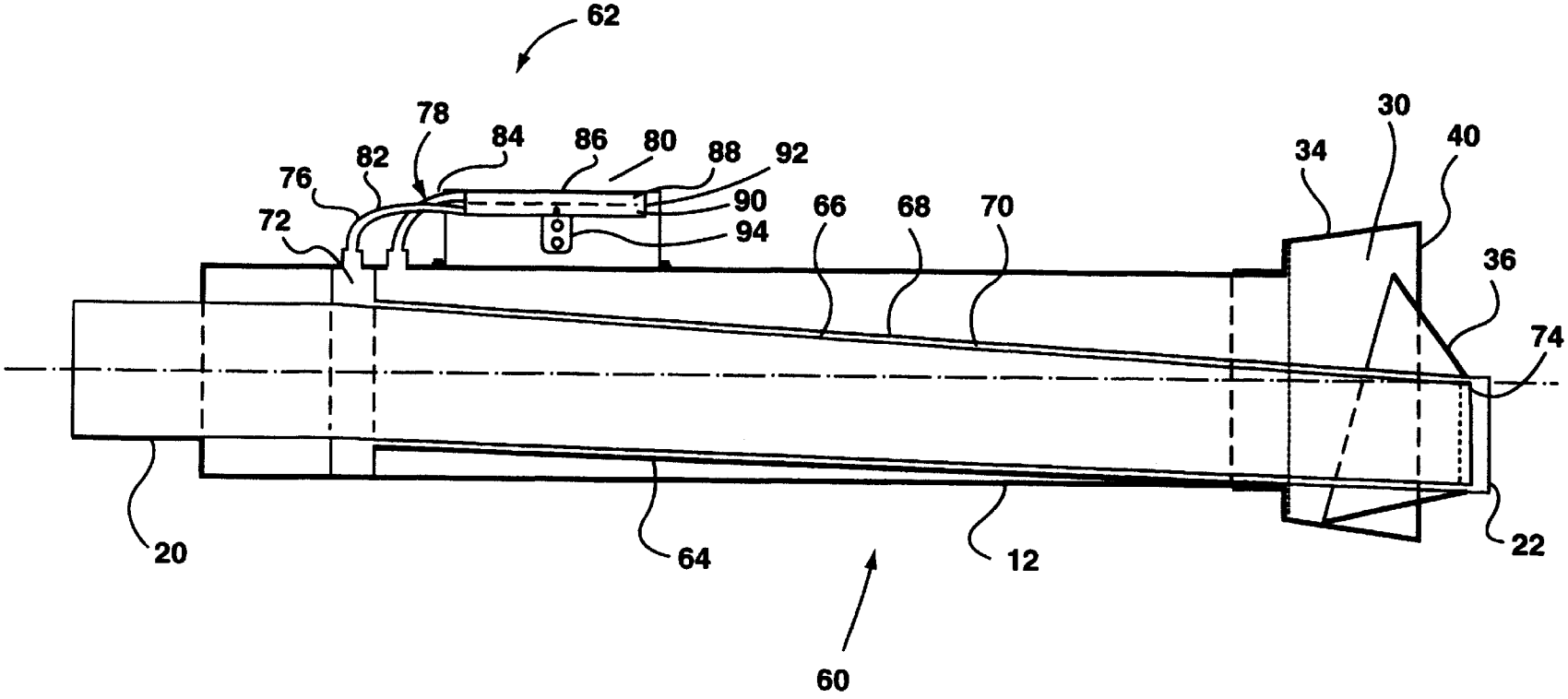
FIG. 7 is a sectional side view of the device of FIG. 6, taken through the line 6—6.
Figure 8:
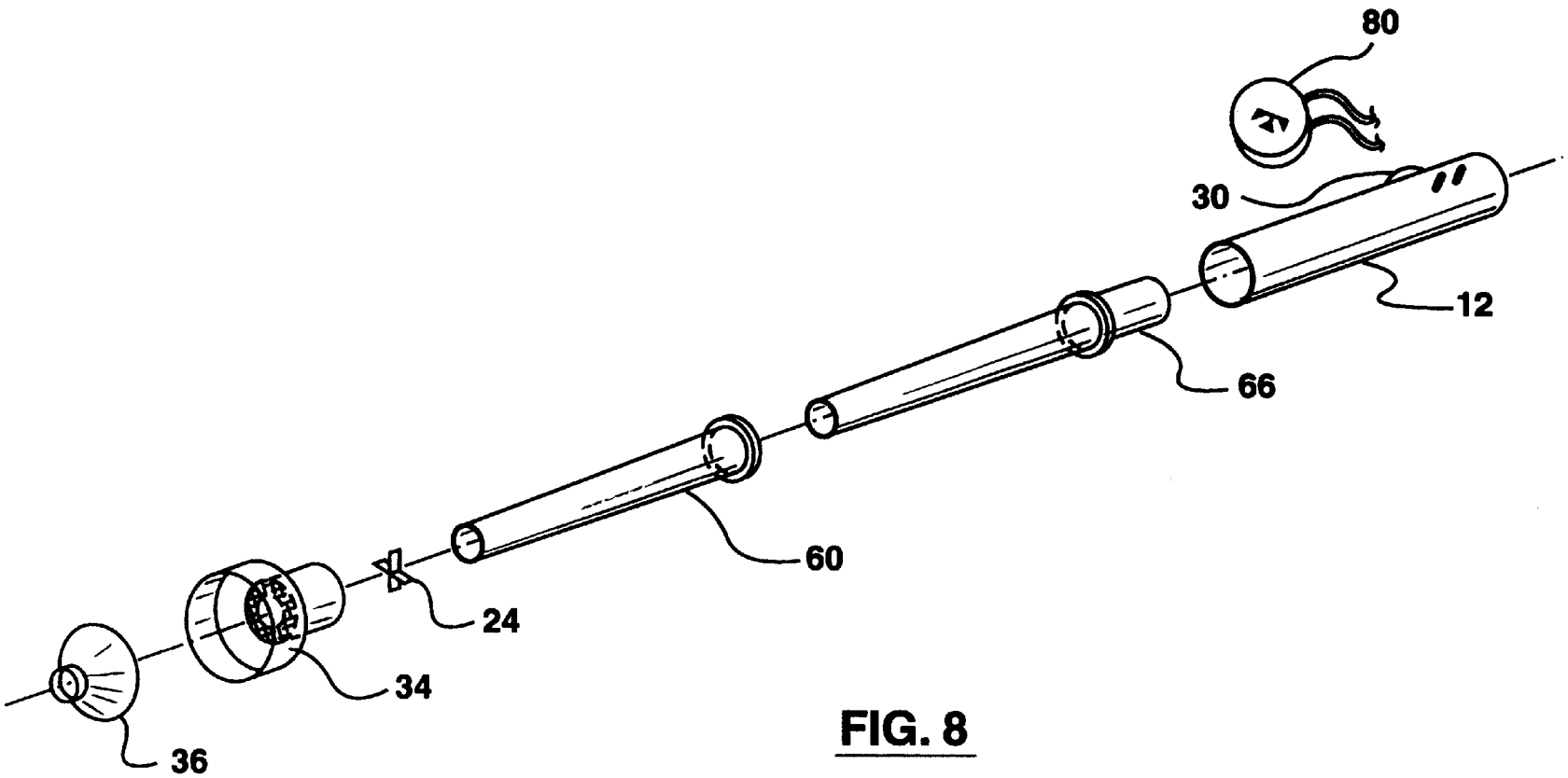
FIG. 8 is an exploded view of the device of FIG. 6.

Referring to FIGS. 6, 7 and 8, illustrated therein is a terminal 60 made in accordance with a preferred embodiment of the present invention including a pressure sensing assembly 62. Terminal 60 is similar to terminal 10 of FIG. 1, except for a modified vent conduit assembly 64, comprising a vent conduit sleeve 66 and a static pressure sleeve 68. Static pressure sleeve 68 is mounted, more or less concentrically, over vent conduit sleeve 66 to define an air space 70, which begins at outlet end 22 and extends to a manifold 72. Shield 36 is attached to, and extends from, the outside of static pressure sleeve 68, in a similar manner as with vent conduit 14 of the embodiment of FIG. 1. Vent conduit sleeve 66 is connected to vent pipe connection 20 and has an sleeve end 74 disposed slightly interior to outlet end of static pressure sleeve, for reasons described below.

Pressure sensing assembly 62 comprises a vent pressure sensor 76 and an intake pressure sensor 78 and a pressure switch assembly 80. Vent pressure sensor 76 is positioned to sense the pressure of air in manifold 72. It will be understood that the air pressure in manifold 72 will be substantially identical to the static pressure of sleeve end 74 of vent conduit sleeve 66. Intake pressure sensor 78 is positioned to sense the pressure of air in intake conduit 12. Switch assembly 80 continuously monitors the pressures measured by sensors 76 and 78, and is capable of providing an electric signal to a furnace control circuit 95 (see FIG. 9), as described further below.

Figure 9:
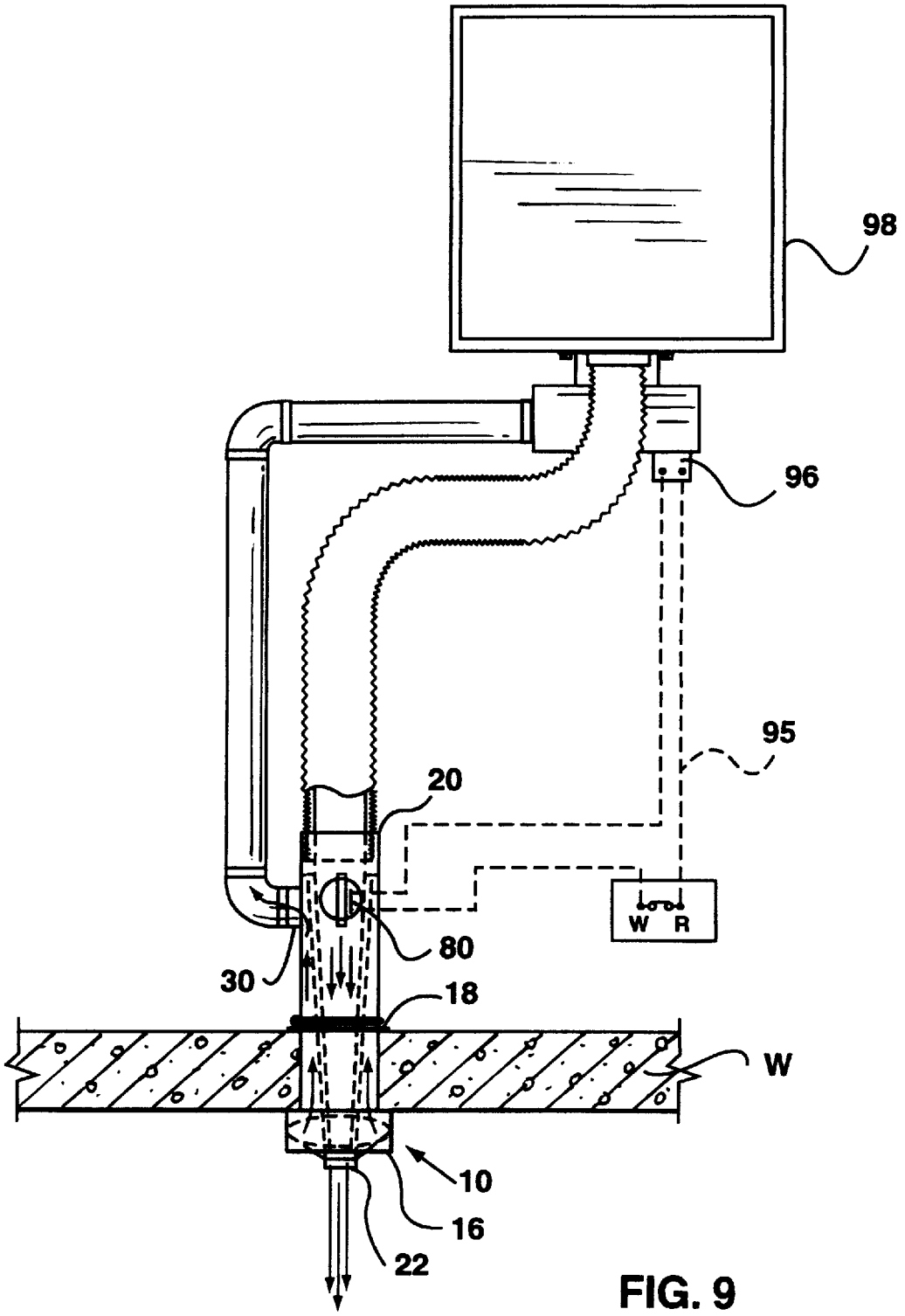
FIG. 9 is a diagrammatic view of the connection of the device of FIG. 6 to a typical fuel fired furnace.

It will be recognized that any means of sensing manifold 72 and intake conduit 12 pressure known in the art may be employed, in conjunction with any pressure switch system known in the art, to achieve the advantageous result of the present invention. In the embodiment preferred and shown in FIG. 7, a simple system is used. Sensors 76 and 78 comprise air tubes 82 and 84. One skilled in the art will appreciate that air tubes 82 and 84 must be of sufficient diameter, and preferably of short length, to reduce any chance of debris, etc., clogging in the tubes. Tubes 82 and 84 are connected to, and in flow communication with, a sealed chamber 86. Chamber 86 is divided into two equally-sized sealed subchambers, namely vent subchamber 88 and intake subchamber 90, by a flexible diaphragm 92. A switch 94 is positioned adjacent intake subchamber 90 (see FIG. 7) and is, as shown in FIG. 9, electrically connected to the control circuit 95, having a thermostat 96, of a furnace 98, as will be described in more detail below. Electric switch 94 is opened by a deflection of diaphragm 92 away from switch 94. When switch 94 is open, the electrical control circuit 95 is broken, and the operation of the burner in furnace 98 is stopped.

By comparing the pressures measured by sensors 76 and 78, pressure sensing assembly 62 can control a combustion burner in furnace 98, such that the burner can be safely shut down by switch 94 if and when intake passage 38 and/or vent outlet end 22 become blocked by snow, ice or other environmental debris.

Referring again to FIG. 6, the pressure assembly 62 is shown during normal operation of terminal 60. Inlet 38 and outlet 22 are unblocked and therefore, as described above, there is a slight pressure differential caused by the normal operating combustion pressure differential of the operation of furnace 98. The approximately equal pressures in vent conduit 14 and intake conduit 12 result in approximately equal pressures in subchambers 88 and 90. Accordingly, diaphragm 92 is almost neutrally positioned, keeping switch 94 in the closed position, and the continued operation of furnace 98 is permitted.

Figure 10:
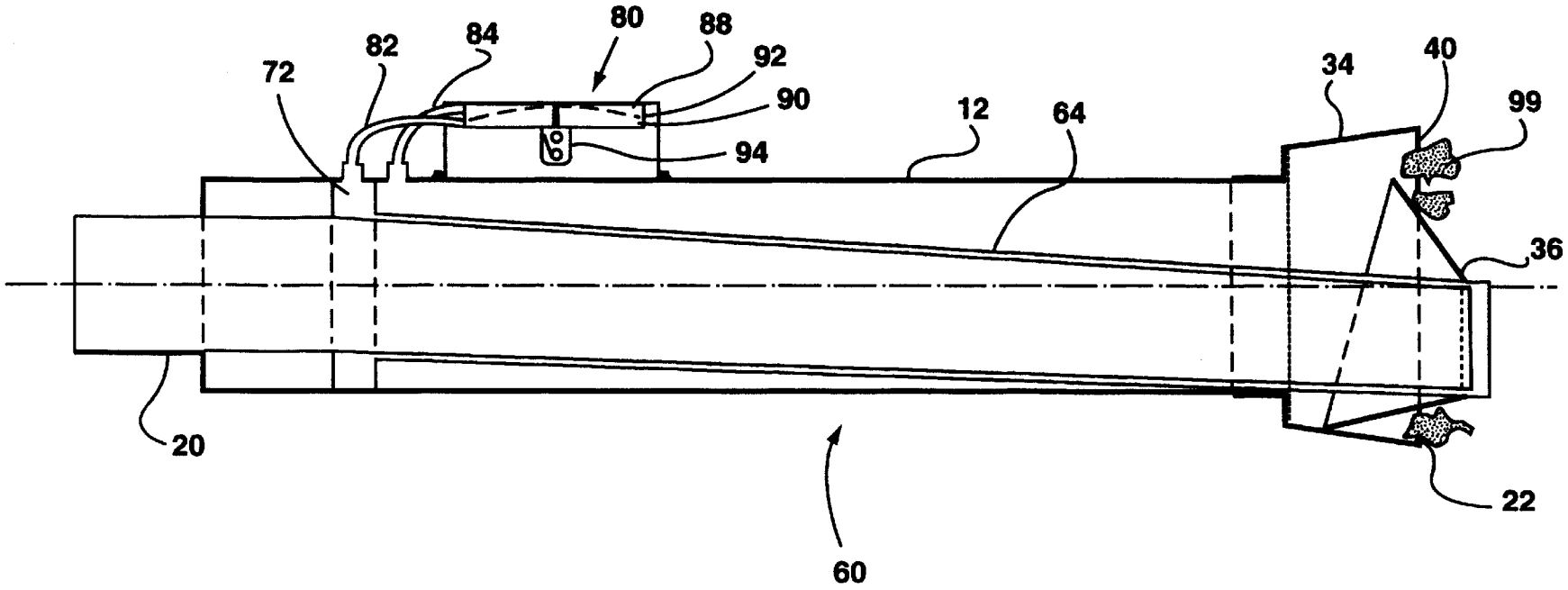
FIG. 10 is a sectional side view of the device of FIG. 6, shown in a partially blocked state.

Referring to FIG. 10, terminal 60 is shown with intake passage 38 blocked by debris 99, such as snow or ice, creating a dangerous operational situation for furnace 98.

The blockage 99 in intake passage 38 causes a pressure drop in intake conduit 12. Correspondingly, the pressure also drops in subchamber 90, and diaphragm 92 moves away from switch 94, thereby opening it. Switch 94 accordingly breaks control circuit 95, which stops operation of the burner in furnace 98. Removal of debris 99 will rebalance pressures in subchamber 88 and 90, and diaphragm 92 will return to a neutral position and thereby automatically reset switch 94 and close control circuit 95.

Figure 11:
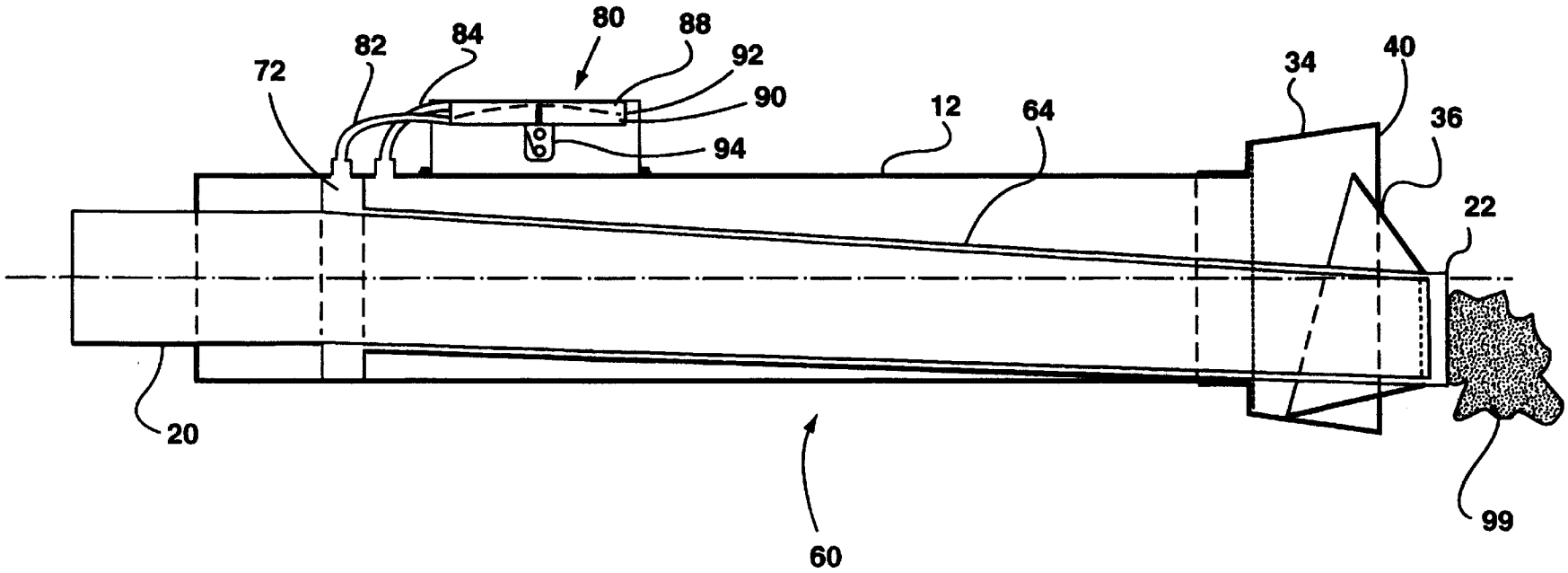
FIG. 11 is a sectional side view of the device of FIG. 6, shown in a partially blocked state.

Referring to FIG. 11, terminal 60 is shown with vent outlet 22 blocked by debris 99, again creating a dangerous operational situation for furnace 98. The blockage 99 in outlet 22 causes a pressure increase in vent conduit 14. Correspondingly, the pressure also increases in subchamber 88, and diaphragm 92 again moves away from switch 94, thereby opening it. Switch 94 accordingly breaks control circuit 95, which stops operation of the burner in furnace 98. Again, removal of debris 99 will automatically reset switch 94 and close control circuit 95.

Figure 12:
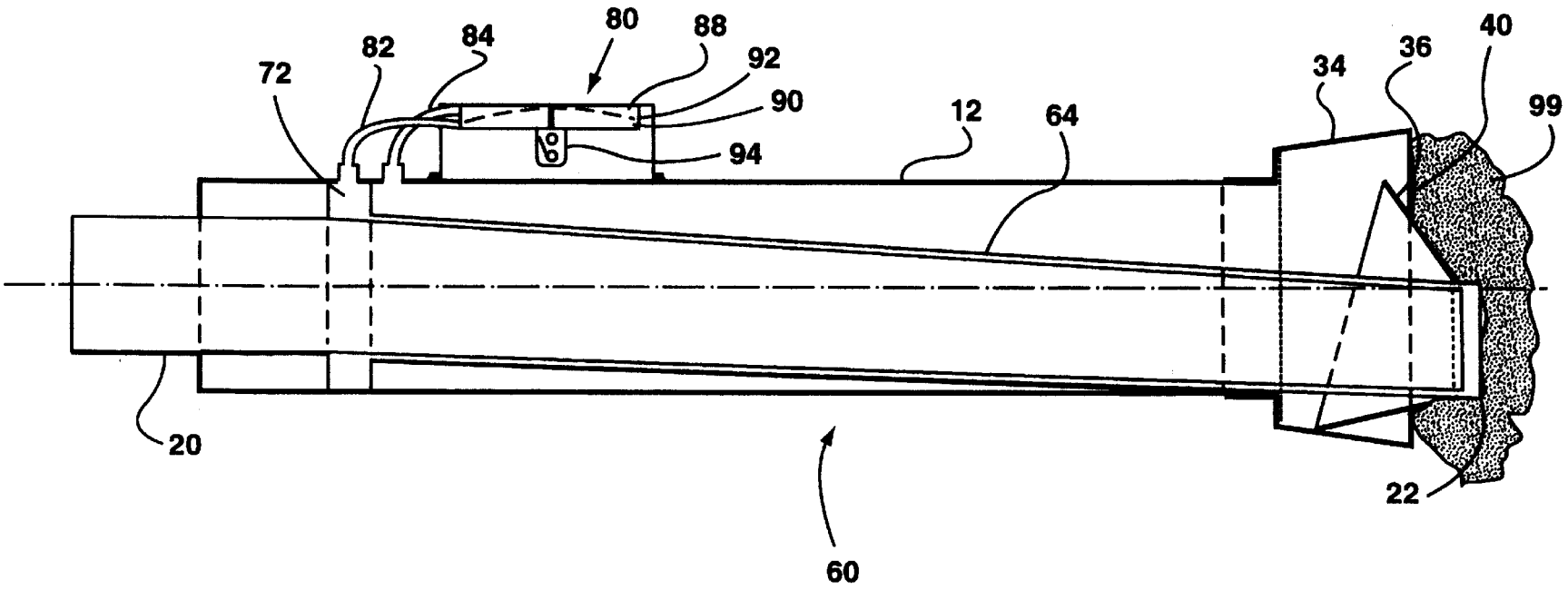
FIG. 12 is a sectional side view of the device of FIG. 6, shown in a fully blocked state.

Referring to FIG. 12, terminal 60 is shown with both vent outlet 22 and intake passages 38 blocked by debris 99. The blockage 99 causes both a pressure increase in vent conduit 14 and a pressure drop in intake conduit 12. The pressures in subchamber 88 and 90 respond correspondingly, and diaphragm 92 again moves away from switch 94, thereby opening it. Switch 94 breaks control circuit 95, which stops operation of the burner in furnace 98.

Figure 13:
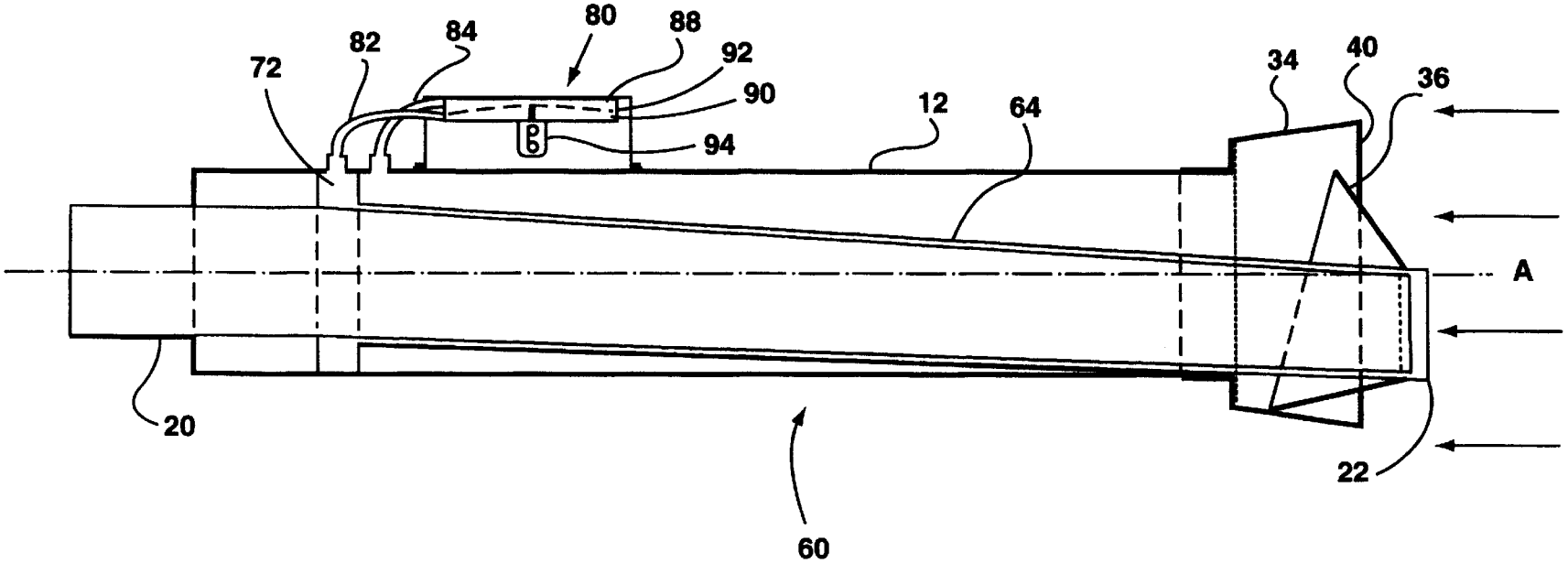
FIG. 13 is a sectional side view of the device of FIG. 6, shown responding to a strong, direct axial wind.

Referring to FIG. 13, terminal 60 is shown with both vent outlet 22 and intake passages 38 clear, but subjected to a strong, direct axial wind, indicated by arrows A. The wind causes a strong pressure increase in both vent conduit 14 and intake conduit 12. The pressures in subchamber 88 and 90 respond correspondingly, and diaphragm 92 moves slightly away from switch 94, but not sufficiently to open switch 94. Advantageously, switch 94 is not activated falsely by a strongly positive wind pressure.

Figure 14:
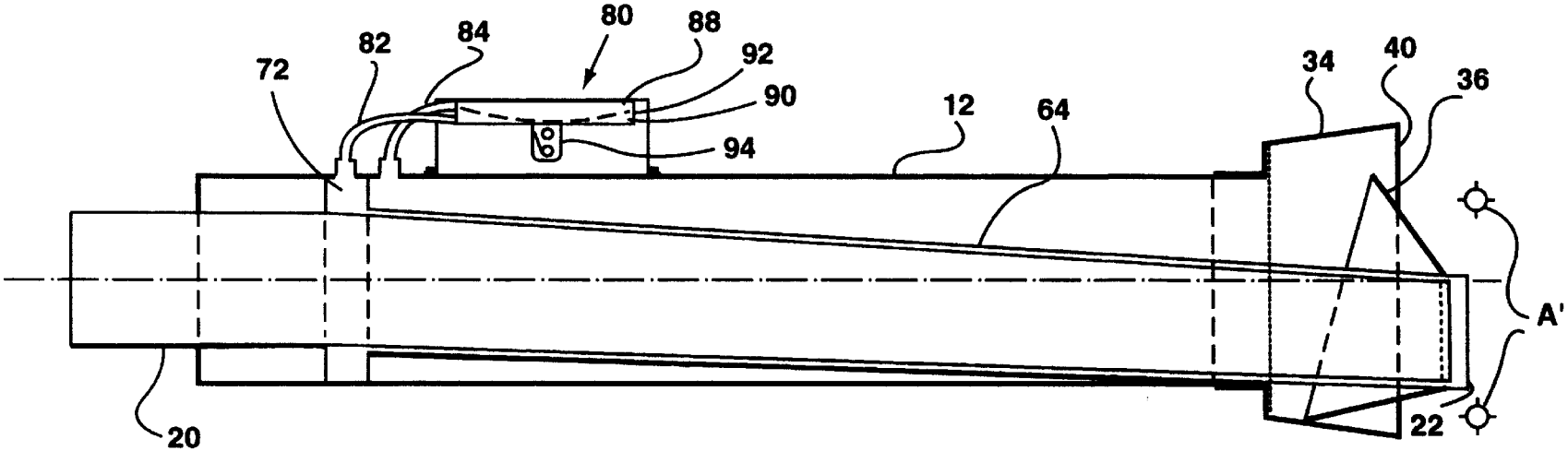
FIG. 14 is a sectional side view of the device of FIG. 6, shown responding to a strong transverse wind.

Referring to FIG. 14, terminal 60 is shown with both vent outlet 22 and intake passages 38 clear, but subjected to a strong, transverse wind, indicated by arrows A'. The wind causes a strong pressure decrease in both vent conduit 14 and intake conduit 12. The pressures in subchamber 88 and 90 respond correspondingly, and diaphragm 92 moves towards switch 94, but does not permit switch 94 to open. Switch 94 is therefore also not activated falsely by a strongly negative wind pressure.

The terminals 10 and 60 may be made of any material known in the art. As vent gases typically carry a fair amount of moisture, it is preferably that such material be corrosion resistant. The preferred embodiments of terminals 10 and 60 are made of 24 gauge stainless steel sheet metal.

One skilled in the art will recognize that the terminal of the present invention need not have a cylindrical geometry, but may also be generally rectangular or other desired shape.

The vent/intake terminal of the present invention has several advantages over the prior art. In one aspect, the invention provides a vent/intake terminal which provides good pressure balance in all wind situations and is suitable for use with furnaces having low combustion pressure differentials, such as high efficiency oil-fired furnaces, or other furnaces having gun-type power burners. The prior art devices do not provide the necessary pressure increases at the intake inlet to permit those terminals to be used with low combustion pressure differential furnaces and still obtain acceptable performance in strong wind situations.

In another aspect, the vent/intake terminal of the present invention provides improved anti-recirculation characteristics over the prior art. The tapered vent conduit accelerates the low speed vent gases of a high-efficiency oil-fired furnace and permits the gases to be forcibly ejected from the outlet end of the terminal, the greatest extent possible given the relatively low pressures available from a gun-type power burner, such as are used in high efficiency oil furnaces. Asymmetric placement of the vent conduit within the intake conduit further separates the vented and intake flows. Also, the presence of a shield member blocking direct axial access to the intake inlet further improves the anti-recirculation characteristics of the present invention. Furthermore these elements, jointly and severally, permit a lower profile vent/intake conduit than provided in prior art concentric vent/intake terminals.

One skilled in the art will recognize that the foregoing advantages, while directed to high-efficiency oil-fired furnaces having low combustion pressure differentials, are also provided, and some cases provided to an even greater extent, when the terminal of the present invention is used in conjunction with a induced draft furnace, natural gas fireplace, or other direct-vented appliance.

In yet another aspect, the present invention provides an improved safety shut off system to shut down burner operation in response to partial of complete terminal blockage. The terminal of the present invention provides an inexpensive and easy to manufacture sensor and switch system which is simple to install and contains few moving parts requiring maintenance or repair. Furthermore, the integration of a shut off system directly into the terminal provides easier access for servicing, etc. than prior art devices disposed interior to the furnace casing itself.

Yet a further advantage is that the integral pressure sensing means provided in the terminal of the present invention need not be adjusted or calibrated by persons installing the terminal in a building. The device may be fully factory-tested and factory-calibrated, reducing the time and skill-level required of a person installing the terminal. Furthermore, as this aspect of the present invention relates to a safety system, it is desirable to not permit field personnel or others to tamper with the calibration of the device.

While the above description constitutes the preferred embodiment, it will be appreciated that the present invention is susceptible to modification and change without parting from the fair meaning of the proper scope of the accompanying claims.

I claim:

1. A horizontal air intake and combustion gas vent terminal positionable in an exterior wall of a building for admitting outside air to a fuel fired furnace in the building and venting combustion gas therefrom to the outside of the building, the terminal comprising:

(a) a vent conduit for receiving combustion gases from the furnace, the vent conduit extending along a longitudinal vent axis and having a length and an open vent outlet end positionable to extend outwardly from the exterior wall for venting the combustion gases to the outside of the building, the vent conduit being tapered along the length thereof towards the vent outlet end for accelerating a flow of combustion gas therethrough; and (b) an intake conduit disposed around the vent conduit and extending along a longitudinal intake axis, the intake conduit having an air flow space defined therein in cooperation with the vent conduit for receiving a horizontal flow of outside air through an open intake inlet end and delivering said air through the air flow space to the furnace, the intake inlet end being positionable between the vent outlet end and the wall; and (c) wherein the longitudinal vent axis and the longitudinal intake axis are noncoaxial and nonparallel, and the longitudinal vent axis is disposed substantially below the longitudinal intake axis at the vent outlet end.

2. The horizontal air intake and combustion gas vent terminal of claim 1, further comprising a shield member disposed around the vent conduit and spaced apart from the intake inlet end, the shield member extending outwardly from the vent conduit to a position wherein the shield member substantially blocks direct axial access of air to the intake inlet end.

3. The horizontal air intake and combustion gas vent terminal of claim 1, further comprising a sleeve member disposed around the intake conduit having a first end merged with the intake conduit and a second end positionable to extend outwardly from the wall to a position intermediate the intake inlet end and the vent outlet end.

* * * * *